US009915274B2

(12) United States Patent
Ovchinnikov et al.

(10) Patent No.: US 9,915,274 B2
(45) Date of Patent: Mar. 13, 2018

(54) ACOUSTIC PUMPS AND SYSTEMS

(71) Applicant: Novartis AG, Basel (CH)

(72) Inventors: Mikhail Ovchinnikov, Dana Point, CA (US); Satish Yalamanchili, Irvine, CA (US); Jianbo Zhou, Rancho Santa Margarita, CA (US)

(73) Assignee: Novartis AG (CH)

( * ) Notice: Subject to any disclaimer, the term of this patent is extended or adjusted under 35 U.S.C. 154(b) by 767 days.

(21) Appl. No.: 14/019,224

(22) Filed: Sep. 5, 2013

(65) Prior Publication Data

US 2014/0271249 A1 Sep. 18, 2014

Related U.S. Application Data

(60) Provisional application No. 61/792,095, filed on Mar. 15, 2013.

(51) Int. Cl.

| | |
|---|---|
| ***F04B 43/04*** | (2006.01) |
| ***F04D 33/00*** | (2006.01) |
| ***F04B 19/00*** | (2006.01) |

(52) U.S. Cl.

CPC ..... *F04D 33/00* (2013.01); *F04B 19/006* (2013.01); *F04B 43/043* (2013.01)

(58) Field of Classification Search

CPC ..... F04D 33/00; H01L 23/467; F04B 19/006; F04B 43/043

USPC ..... 417/410.2

See application file for complete search history.

(56) References Cited

U.S. PATENT DOCUMENTS

| | | | |
|---|---|---|---|
| 121,697 | A | 12/1871 | Wheatland |
| 294,334 | A | 2/1884 | Reed et al. |
| 351,159 | A | 10/1886 | Bengel |
| 865,631 | A | 9/1907 | Cotter et al. |
| 1,061,142 | A | 5/1913 | Tesla |
| 1,061,206 | A | 5/1913 | Tesla |
| 1,874,667 | A | 8/1932 | Yoshinobu et al. |
| 2,015,123 | A | 9/1935 | Samuel et al. |
| 2,121,936 | A | 6/1938 | Thomas et al. |
| 2,386,765 | A | 10/1945 | Adams et al. |
| 2,536,836 | A | 1/1951 | Bowling et al. |
| 2,623,725 | A | 12/1952 | Sands et al. |
| 2,755,816 | A | 7/1956 | Collins et al. |
| 2,987,004 | A | 6/1961 | Murray et al. |

(Continued)

FOREIGN PATENT DOCUMENTS

| | | |
|---|---|---|
| CA | 2316640 | 2/2001 |
| CA | 2649867 A1 | 6/2001 |

(Continued)

OTHER PUBLICATIONS

International Search Report for PCT/US2010/058931, filed Dec. 3, 2010, Publication No. 2011071775, Published Jun. 16, 2011, 2 pages.

(Continued)

*Primary Examiner* — Peter J Bertheaud

(57) ABSTRACT

A microfluidics acoustic pump system includes a flow passage configured to carry a fluid from one location to another, a selectively vibrating flow generator having a sharp edge, and a driving device configured to vibrate one of the flow generator and the flow passage to create a streaming fluid flow in a direction away from the sharp edge through the flow passage.

7 Claims, 5 Drawing Sheets

(56) References Cited

U.S. PATENT DOCUMENTS 3,085,589 A 4/1963 Sands et al.
3,191,807 A 6/1965 Rodrigues et al.
3,336,942 A 8/1967 Keith et al.
3,447,478 A 6/1969 Clemens et al.
3,487,784 A 1/1970 Rafferty et al.
3,561,471 A 2/1971 Sands et al.
3,567,345 A 3/1971 Ballentine et al.
3,589,363 A 7/1971 Banko et al.
3,693,613 A 9/1972 Kelman et al.
3,724,974 A 4/1973 Molimard
3,756,270 A 9/1973 Fonseca et al.
3,784,323 A 1/1974 Sausse
3,818,913 A 6/1974 Wallach
3,882,872 A 5/1975 Douvas et al.
3,930,505 A 1/1976 Wallach
3,996,935 A 12/1976 Banko
4,063,826 A * 12/1977 Riepe ..... F04D 33/00 417/410.1
4,140,118 A 2/1979 Jassawalla
4,187,057 A 2/1980 Xanthopoulos
4,205,948 A 6/1980 Jones
4,255,081 A 3/1981 Oklejas et al.
4,392,794 A 7/1983 Foxcroft
4,405,289 A 9/1983 Nakashima
4,479,761 A 10/1984 Bilstad et al.
4,493,706 A 1/1985 Borsanyi et al.
4,496,342 A 1/1985 Banko
4,530,647 A 7/1985 Uno
4,537,561 A 8/1985 Xanthopoulos
4,657,490 A 4/1987 Abbott
4,661,093 A 4/1987 Beck et al.
4,684,328 A 8/1987 Murphy
4,705,500 A 11/1987 Reimels et al.
4,713,051 A 12/1987 Steppe et al.
4,758,238 A 7/1988 Sunblom et al.
4,764,165 A 8/1988 Reimels et al.
4,768,547 A 9/1988 Danby et al.
4,790,726 A 12/1988 Balkau et al.
4,798,580 A 1/1989 DeMeo et al.
4,838,865 A 6/1989 Flank et al.
4,854,825 A 8/1989 Bez et al.
4,861,332 A 8/1989 Parisi
4,904,238 A 2/1990 Williams
4,909,710 A 3/1990 Kaplan et al.
4,909,713 A 3/1990 Finsterwald et al.
4,921,477 A 5/1990 Davis
4,923,000 A * 5/1990 Nelson ..... F04D 33/00 165/122
4,923,375 A 5/1990 Ejlersen
4,935,005 A 6/1990 Haines
4,963,131 A 10/1990 Wortrich
5,038,965 A 8/1991 Cater
5,041,096 A 8/1991 Beuchat et al.
5,044,902 A 9/1991 Malbec
5,046,486 A 9/1991 Grulke et al.
5,062,775 A 11/1991 Orth
5,106,366 A 4/1992 Steppe
5,106,367 A 4/1992 Ureche et al.
5,151,883 A * 9/1992 Mitome ..... B06B 1/02 310/334
5,167,620 A 12/1992 Ureche et al.
5,185,002 A 2/1993 Venturini
5,195,960 A 3/1993 Hossin et al.
5,207,647 A 5/1993 Phelps
5,257,917 A 11/1993 Minarik
5,263,830 A 11/1993 Goi et al.
5,267,956 A 12/1993 Beuchat
5,273,517 A 12/1993 Barone et al.
5,302,093 A 4/1994 Owens et al.
5,316,440 A 5/1994 Kijima et al.
5,342,181 A 8/1994 Schock et al.
5,350,357 A 9/1994 Kamen et al.
5,364,342 A 11/1994 Beuchat et al.
5,392,653 A 2/1995 Zanger et al.
5,403,277 A 4/1995 Dodge et al.
5,429,485 A 7/1995 Dodge
5,429,601 A 7/1995 Conley et al.
5,429,602 A 7/1995 Hauser
5,443,370 A 8/1995 Wang
5,460,490 A 10/1995 Carr et al.
5,462,416 A 10/1995 Dennehey et al.
5,470,312 A 11/1995 Zanger et al.
5,476,448 A 12/1995 Urich
5,484,239 A 1/1996 Chapman et al.
5,487,747 A 1/1996 Stagmann et al.
5,515,930 A 5/1996 Glaser
5,518,378 A 5/1996 Neftel et al.
5,533,976 A 7/1996 Zaleski et al.
5,542,918 A 8/1996 Atkinson
5,554,013 A 9/1996 Owens et al.
5,575,632 A 11/1996 Morris et al.
5,588,815 A 12/1996 Zaleski et al.
5,616,118 A 4/1997 Ahmed
5,630,711 A 5/1997 Luedtke et al.
5,674,226 A 10/1997 Doherty et al.
5,688,112 A 11/1997 Garay
5,697,910 A 12/1997 Cole et al.
5,705,018 A 1/1998 Hartley
5,709,539 A 1/1998 Hammer et al.
5,712,543 A 1/1998 Sjostrom
5,733,256 A 3/1998 Costin
5,746,708 A 5/1998 Giesler et al.
5,746,719 A 5/1998 Farra et al.
5,759,017 A 6/1998 Patton et al.
5,782,634 A 7/1998 Lingenhole et al.
5,788,667 A 8/1998 Stoller
5,810,765 A 9/1998 Oda
5,827,218 A 10/1998 Nguyen et al.
5,853,386 A 12/1998 Davis et al.
5,861,703 A * 1/1999 Losinski ..... F04D 33/00 257/E23.099
5,879,363 A 3/1999 Urich
5,897,300 A 4/1999 Luedtke
5,897,524 A 4/1999 Wortrich et al.
5,906,598 A 5/1999 Giesler et al.
5,910,110 A 6/1999 Bastable
5,927,956 A 7/1999 Lim et al.
5,951,581 A 9/1999 Saadat et al.
5,972,012 A 10/1999 Ream et al.
5,989,212 A 11/1999 Sussman et al.
5,996,634 A 12/1999 Dennchey et al.
5,997,499 A 12/1999 Sussman et al.
6,012,999 A 1/2000 Patterson
6,042,586 A 3/2000 Kawano et al.
6,058,779 A 5/2000 Cole
6,080,128 A 6/2000 Sussman et al.
6,109,895 A 8/2000 Ray et al.
6,110,162 A 8/2000 Sussman et al.
6,117,149 A 9/2000 Sorensen et al.
6,129,699 A 10/2000 Haight et al.
6,179,805 B1 1/2001 Sussman et al.
6,217,543 B1 4/2001 Anis et al.
6,241,700 B1 6/2001 Leukanech
6,270,326 B1 8/2001 Kuriyama
6,293,926 B1 9/2001 Sorensen
6,296,460 B1 10/2001 Smith
6,416,293 B1 7/2002 Bouchard et al.
6,491,661 B1 12/2002 Boukhny et al.
6,527,765 B2 3/2003 Kelman et al.
6,551,080 B2 4/2003 Anderson et al.
6,572,349 B2 6/2003 Sorensen et al.
6,588,497 B1 * 7/2003 Glezer ..... F15D 1/009 165/84
6,599,277 B2 7/2003 Neubert
6,605,054 B2 8/2003 Rockley
6,655,934 B2 12/2003 Mittelstein et al.
6,689,146 B1 2/2004 Himes
6,723,065 B2 4/2004 Kishimoto
6,749,403 B2 6/2004 Bryant et al.
6,811,386 B2 11/2004 Hedington et al.
6,814,547 B2 11/2004 Childers et al.
6,868,987 B2 3/2005 Hedington
6,958,058 B1 10/2005 Hunter, Sr. et al.
6,962,488 B2 11/2005 Davis et al.

(56) References Cited

U.S. PATENT DOCUMENTS

| | | | | |
|---|---|---|---|---|
| 7,063,688 | B2 | 6/2006 | Say | |
| 7,070,574 | B2 | 7/2006 | Jackson et al. | |
| 7,144,383 | B2 | 12/2006 | Arnett et al. | |
| 7,150,607 | B2 | 12/2006 | Pelmulder et al. | |
| 7,238,164 | B2 | 7/2007 | Childers et al. | |
| 7,273,359 | B2 | 9/2007 | Blight et al. | |
| 7,276,060 | B2 | 10/2007 | Madden | |
| 7,393,189 | B2 | 7/2008 | Davis et al. | |
| 7,445,436 | B2 | 11/2008 | Mittelstein et al. | |
| 7,540,855 | B2 | 6/2009 | Lumpkin et al. | |
| 7,604,610 | B2 | 10/2009 | Shener et al. | |
| 7,632,080 | B2 | 12/2009 | Tracey et al. | |
| 7,645,127 | B2 | 1/2010 | Hagen et al. | |
| 7,695,242 | B2 | 4/2010 | Fuller | |
| 7,758,515 | B2 | 7/2010 | Hibner | |
| 7,775,780 | B2 | 8/2010 | Hopkins et al. | |
| 7,862,540 | B2 | 1/2011 | Dacquay et al. | |
| 7,967,777 | B2 | 6/2011 | Edwards et al. | |
| 8,070,712 | B2 | 12/2011 | Muri et al. | |
| 8,087,909 | B2 | 1/2012 | Shener | |
| 8,162,633 | B2 | 4/2012 | Edwards | |
| 8,322,889 | B2 * | 12/2012 | Petroski | F04D 33/00 361/694 |
| 8,579,929 | B2 | 11/2013 | MacKool et al. | |
| 8,617,106 | B2 | 12/2013 | Zacharias | |
| 8,814,543 | B2 * | 8/2014 | Liebing | A61M 1/101 417/436 |
| 9,132,034 | B2 | 9/2015 | Dos Santos | |
| 2001/0016706 | A1 | 8/2001 | Leukanech et al. | |
| 2002/0062105 | A1 | 5/2002 | Tanner | |
| 2002/0077587 | A1 | 6/2002 | Boukhny et al. | |
| 2003/0108429 | A1 | 6/2003 | Angelini et al. | |
| 2003/0199803 | A1 | 10/2003 | Robinson et al. | |
| 2004/0122381 | A1 | 6/2004 | Arnold | |
| 2004/0253129 | A1 | 12/2004 | Sorensen et al. | |
| 2005/0049539 | A1 | 3/2005 | O'Hara et al. | |
| 2005/0070859 | A1 | 3/2005 | Cull et al. | |
| 2005/0100450 | A1 | 5/2005 | Bryant et al. | |
| 2005/0271531 | A1 | 12/2005 | Brown, Jr. et al. | |
| 2006/0000925 | A1 | 1/2006 | Maher et al. | |
| 2006/0093989 | A1 | 5/2006 | Hahn et al. | |
| 2006/0110274 | A1 | 5/2006 | Gottschalk | |
| 2006/0122556 | A1 | 6/2006 | Kumar et al. | |
| 2006/0245964 | A1 | 11/2006 | Koslov | |
| 2006/0253194 | A1 | 11/2006 | Dial | |
| 2007/0078370 | A1 | 4/2007 | Shener et al. | |
| 2007/0078379 | A1 | 4/2007 | Boukhny et al. | |
| 2007/0100316 | A1 | 5/2007 | Traxinger | |
| 2007/0135760 | A1 | 6/2007 | Williams | |
| 2007/0217919 | A1 | 9/2007 | Gordan et al. | |
| 2007/0278155 | A1 | 12/2007 | Lo | |
| 2007/0287959 | A1 | 12/2007 | Walter et al. | |
| 2008/0097320 | A1 | 4/2008 | Moore et al. | |
| 2008/0112828 | A1 | 5/2008 | Muri et al. | |
| 2008/0114289 | A1 | 5/2008 | Muri et al. | |
| 2008/0114291 | A1 | 5/2008 | Muri et al. | |
| 2008/0114301 | A1 | 5/2008 | Bandhauer et al. | |
| 2008/0114311 | A1 | 5/2008 | Muri et al. | |
| 2008/0114312 | A1 | 5/2008 | Muri et al. | |
| 2008/0114372 | A1 | 5/2008 | Edwards et al. | |
| 2008/0200878 | A1 | 8/2008 | Davis et al. | |
| 2008/0220092 | A1 | 9/2008 | Dipierro et al. | |
| 2008/0240951 | A1 | 10/2008 | Demash et al. | |
| 2008/0247892 | A1 | 10/2008 | Kawasumi | |
| 2009/0012460 | A1 | 1/2009 | Steck et al. | |
| 2009/0035164 | A1 | 2/2009 | Edwards | |
| 2009/0060756 | A1 | 3/2009 | Jones | |
| 2009/0084718 | A1 | 4/2009 | Prisco et al. | |
| 2009/0246035 | A1 | 10/2009 | Patzer | |
| 2009/0299272 | A1 | 12/2009 | Hopping et al. | |
| 2009/0317271 | A1 | 12/2009 | Gill et al. | |
| 2010/0056979 | A1 | 3/2010 | Smedley et al. | |
| 2010/0125257 | A1 | 5/2010 | Perkins et al. | |
| 2010/0130920 | A1 | 5/2010 | Lo et al. | |
| 2010/0130934 | A1 | 5/2010 | Rochat | |
| 2010/0145259 | A1 | 6/2010 | Nash et al. | |
| 2010/0191178 | A1 | 7/2010 | Ross et al. | |
| 2010/0228146 | A1 | 9/2010 | Hibner | |
| 2010/0241044 | A1 | 9/2010 | Caleffi et al. | |
| 2010/0280435 | A1 | 11/2010 | Raney et al. | |
| 2010/0286791 | A1 | 11/2010 | Goldsmith | |
| 2011/0092891 | A1 | 4/2011 | Gerg et al. | |
| 2011/0137231 | A1 | 6/2011 | Sorensen et al. | |
| 2011/0144567 | A1 | 6/2011 | Sorensen et al. | |
| 2011/0184374 | A1 | 7/2011 | Gao et al. | |
| 2012/0041358 | A1 | 2/2012 | Mann et al. | |
| 2012/0083728 | A1 | 4/2012 | Sorensen et al. | |
| 2013/0019968 | A1 * | 1/2013 | Liebing | A61M 1/101 137/565.01 |

FOREIGN PATENT DOCUMENTS

| | | | |
|---|---|---|---|
| CA | 2743969 | A1 | 3/2005 |
| CA | 2649867 | C | 6/2010 |
| CN | 101023898 | | 8/2007 |
| CN | 200991440 | | 12/2007 |
| DE | 3809582 | | 10/1989 |
| DE | 19749358 | | 5/1998 |
| DE | 19711675 | | 10/1998 |
| DE | 19856744 | | 6/2000 |
| DE | 10034711 | B4 | 2/2002 |
| DE | 10034711 | A1 | 4/2006 |
| DE | 102007044790 | | 4/2009 |
| EP | 0200448 | | 5/1986 |
| EP | 0320963 | | 6/1989 |
| EP | 0362822 | | 4/1990 |
| EP | 518050 | A1 | 12/1992 |
| EP | 518050 | B1 | 7/1996 |
| EP | 0944404 | | 9/1999 |
| EP | 1140257 | | 10/2001 |
| EP | 1258260 | | 11/2002 |
| EP | 964711 | | 4/2005 |
| EP | 1810702 | | 7/2007 |
| EP | 2173404 | | 4/2010 |
| EP | 2365220 | | 9/2011 |
| EP | 2509659 | | 10/2012 |
| FR | 2466641 | | 4/1981 |
| FR | 2797190 | | 2/2001 |
| GB | 2029514 | | 3/1980 |
| GB | 2174763 | | 11/1986 |
| GB | 2190145 | | 5/1990 |
| JP | 63-290564 | | 11/1988 |
| JP | 02070987 | | 3/1990 |
| JP | H03-164586 | | 7/1991 |
| JP | 2002-248117 | | 9/2002 |
| JP | 3785643 | | 6/2006 |
| JP | 2007-507636 | | 3/2007 |
| JP | 2007-198382 | | 8/2007 |
| JP | 2007-247646 | | 9/2007 |
| JP | 2008-546501 | | 12/2008 |
| RU | 2197277 | | 1/2003 |
| RU | 2241887 | | 12/2004 |
| SU | 1533696 | | 1/1990 |
| SU | 1590649 | | 9/1990 |
| WO | WO 98/18507 | | 5/1998 |
| WO | WO 98/24495 | | 6/1998 |
| WO | WO 99/38549 | | 8/1999 |
| WO | WO 2000/22995 | | 4/2000 |
| WO | WO 00/33898 | | 6/2000 |
| WO | WO 00/53136 | | 9/2000 |
| WO | WO 2003 073969 | | 9/2003 |
| WO | WO 2005009511 | A2 | 2/2005 |
| WO | WO 2005009511 | A3 | 6/2005 |
| WO | WO 2008/131357 | | 10/2008 |
| WO | WO 09/005900 | | 1/2009 |
| WO | WO 09/146913 | A2 | 12/2009 |
| WO | WO 09/146913 | A3 | 2/2010 |
| WO | WO 10/061863 | | 6/2010 |
| WO | WO 10/129128 | | 11/2010 |
| WO | WO 2011/071775 | | 6/2011 |

(56) References Cited

FOREIGN PATENT DOCUMENTS

| | | |
|---|---|---|
| WO | WO 2012048261 A2 | 4/2012 |
| WO | WO 2012048261 A3 | 6/2012 |

OTHER PUBLICATIONS

Written Opinion of the International Searching Authority, International Application No. PCT/US2010/058931, dated Feb. 1, 2011, 4 pages.
International Search Report for PCT/US2010/059032, filed Dec. 6, 2010, Publication No. 2011075332, Published Jun. 23, 2011, 2 pages.
Written Opinion of the International Searching Authority, International Application No. PCT/US2010/059032, dated Jan. 31, 2011, 5 pages.
(Citing Office Action), Non-Final Office Action, U.S. Appl. No. 12/637,886, filed Oct. 3, 2011, 11 pages.
Supplementary European Search Report for Application No. EP 10836456.3, Publication No. EP 2509659, Published Oct. 17, 2012, dated Mar. 20, 2013, 5 pages.
Supplementary European Search Report for Application No. EP 10838118.7, Publication No. EP2512554, Published Oct. 24, 2012, dated Apr. 15, 2013, 6 pages.
Milutinovic, et al., "Phacoemulsification Fluidics System Having a Single Pump Head," U.S. Appl. No. 12/818,682, filed Jun. 18, 2010, 28 pages.
International Searching Authority, Written Opinion of the International Searching Authority, International Application No. PCT/US2010/030168, dated Aug. 3, 2010, 8 pages.
International Search Report and Written Opinion of the International Searching Authority, International Application No. PCT/US2014/027271, filed Mar. 14, 2014, dated Jul. 28, 2014, 8 pages.
International Search Report and Written Opinion of the International Searching Authority, International Application No. PCT/US2014/027233 , filed Mar. 14, 2014, dated Jul. 31, 2014, 10 pages.
International Search Report and Written Opinion of the International Searching Authority, International Application No. PCT/US2014/027307, filed Mar. 14, 2014, dated Jul. 30, 2014, 7 pages.
Sorensen, Gary, Phacoemulsification Hand Piece with Integrated Aspiration Pump, U.S. Appl. No. 13/325,549, filed Dec. 14, 2011, 18 pages.
http://www.advancedfluid.com/discflo/concepts.htm. Web archive dated Aug. 8, 2008, 3 pages.
Ovchinnikov et al., Acoustic Streaming of a Sharp Edge, Journal of Acoustical Society of America, 136 (1), Jul. 2014, pp. 22-29.
European Application No. 13863111.4, Extended European Search Report dated Jul. 14, 2015, 6 pgs.
International Application No. PCT/US2010/058931, International Preliminary Report on Patentability dated Jun. 12, 2012, 5 pgs.
International Application No. PCT/US2014/027271, International Preliminary Report on Patentability dated Sep. 15, 2015, 6 pgs.
International Application No. PCT/US2014/027307, International Preliminary Report on Patentability dated Sep. 15, 2015, 5 pgs.
International Application No. PCT/US2010/059032, International Preliminary Report on Patentability dated Jun. 19, 2012, 6 pgs.
International Application No. PCT/US2013/064202, International Preliminary Report on Patentability dated Jun. 16, 2015, 6 pgs.
International Application No. PCT/US2014/027233, International Preliminary Report on Patentability dated Sep. 15, 2015, 8 pgs.
International Application No. PCT/US2017/064416, International Preliminary Report on Patentability dated Jun. 7, 2016, 8 pgs.
International Application No. PCT/US2015/026293, International Search Reporting and Written Opinion dated Jul. 23, 2015, 10 pgs.
International Application No. PCT/US2010/041786, International Search Report dated Oct. 28, 2010, 5 pgs.
International Application No. PCT/US2015/037783, International Search Report dated Sep. 28, 2015, 4 pgs.
International Application No. PCT/US2009/057675, Written Opinion dated Mar. 25, 2011, 5 pgs.
International Application No. PCT/US2010/041786, Written Opinion dated Oct. 28, 2010, 6 pgs.
International Application No. PCT/US2015/037783, Written Opinion dated Sep. 28, 2010, 5 pgs.
Barenblatt, G. I., *Scaling, self-similarity, and intermediate asymptotics*, 1966, pp. iv-15, Cambridge University Press, Cambridge.
Boluriaan, S. et al., *Acoustic streaming: from Rayleigh to today*, aeroacoustics, 2003, pp. 255-292, vol. 2, No. 3 & 4.
Faraday, M., *On a Peculiar Class of Acoustical Figures; and on Certain Forms Assumed by Groups of Particles upon Vibrating Elastic Surface*, Philosophical Transactions of the Royal Society of London, 1831, pp. 299-340, vol. 121.
Holtsmark et. al., *Boundary Layer Flow near a Cylindrical Obstacle in an Oscillating Incompressible Fluid*, J. Acoust. Soc. Am., 1954, p. 102, 26.
Ingard, U. et al., Acoustic Circulation Effects and the Nonlinear Impedance of Orifices*, The Journal of the Acoustical Society of America, Mar. 1950, pp. 211-218, vol. 22, No. 2.
James, R. D. et al., A round turbulent jet produced by an oscillating diaphragm, Physics of Fluids, Sep. 1996, pp. 2484-2495, vol. 8, No. 9.
Kishimoto, Makoto, MD, Opesaver-Super Irrigation System, Techniques in Ophthalmology, 2006, 6 pages, vol. 4, Issue 1, Lippincott Williams & Wilkins, Shiga, Japan.
Landau, D. et al. (See for example), One-Dimensional Gas Flow, Fluid Dynamics, 1987. pp. 361-413, par. 10, problem 6, Pergamon Press, Oxford.
Lebedeva, I.V., Experimental study of acoustic streaming in the vicinity of orifices, Sov. Phys. Acoust., Jul.-Aug. 1980, pp. 331-333, vol. 26(4), Americal Institute of Physics.
Lighthill, J., Acoustic Streaming, Journal of Sound and Vibration, Jul. 1978, pp. 391-418, 61(3), Academic Press Inc., London.
Loh, B-G et al., Acoustic streaming induced by ultrasonic flexural vibrations and associated enhancement of convective heat transfer, J. Acoust. Soc. Am., Feb. 2002, pp. 875-883, vol. 111, No. 2.
Mednikov, E. P. et al., Experimental study of intense acoustic streaming, Sov. Phys. Acoust., Mar.-Apr. 1975, p. 152-154, vol. 21, No. 2.
Nyborg, W. L., Acoustic Streaming due to Attenuated Plane Waves, The Journal of the Acoustical Society of America, Sep. 30, 1952, pp. 68-75, vol. 25.
Nyborg, W. L., Acoustic Streaming near a Boundary*, The Journal of the Acoustical Society of America, Dec. 16, 1957, pp. 329-339, vol. 30, No. 4.
Rayleigh, L., Theory of Sound, 1945, Par. 352, Dover Publications, New York.
Riley, N., Acoustic streaming about a cylinder in orthogonal beams, J. Fluid Mech., 1992, pp. 387-394, vol. 242.
Riley, N., Acoustic Streaming, Encyclopedia of Acoustics, 1997, pp. 321-327, vol. 1, ed M. J. Crocker, John Wiley & Sons, Inc., New York.
Riley, N., On a Sphere Oscillating in a Viscous Fluid, Quart. Journ. Mech. and Applied Math, Jan. 1966, pp. 461-472, vol. 19, Pt. 4.
Riley, N., Oscillatory Viscous Flows. Review and Extension, J. Inst. Maths Applics, Jan. 30, 1967, pp. 419-434, 3.
Stuart, J. T., Double boundary layers in oscillatory viscous flow, J. Fluid Mech., 1966, pp. 673-687, vol. 24, part 4.
Taneda, S., Visualization of Steady Flows Induced by a Circular Cylinder Performing a Rotatory Oscillation about an Eccentric Axis, Journal of the Physical Society of Japan, Nov. 1980, pp. 2038-2041, vol. 49, No. 5.
Zacharias, J. et al., Fluid dynamics, cavitation, and tip-to-tissue interaction of longitudinal and torsional ultrasound modes during phacoemulsification, presentation at ASCRS meeting, 2010, pp. 611-616. Boston.

* cited by examiner

ACOUSTIC PUMPS AND SYSTEMS

CROSS REFERENCE TO RELATED APPLICATIONS

This application claims the benefit of U.S. Provisional Application No. 61/792,095 filed Mar. 15, 2013, the contents of both being incorporated herein by reference.

BACKGROUND

The present disclosure relates to acoustic pumps, and more particularly to acoustic pumps for micropump applications.

Micropumps are being developed and used in the fields of microfluidics research, including BioMEMS and lab-on-a-chip devices. Currently there are two broad types of micropumps: mechanical and electrochemical. However, each of these types of pumps has limitations. For example, mechanical pumps typically have moving parts. These parts result in pumps that may be complex, may be difficult to manufacture, and may be less reliable. Electrochemical pumps typically work on the basis of volume expansion due to chemical reaction. Usually these types of pumps include a membrane that expands to create the pumping action that drives fluid flow. However, electrochemical micropumps may be expensive, may not being tuneable to different speeds, and may result in permeation of reactants and products.

The present disclosure addresses one or more deficiencies in the prior art.

SUMMARY

In one exemplary aspect, the present disclosure is directed to a microfluidics acoustic pump system that includes a flow passage configured to carry a fluid from one location to another, a selectively vibrating flow generator having a sharp edge, and a driving device configured to vibrate one of the flow generator and the flow passage to create a streaming fluid flow in a direction away from the sharp edge through the flow passage.

In an aspect, the flow generator comprises two nonparallel surfaces forming an angle, the nonparallel surfaces being symmetrically disposed about an axis aligned with an axis of the flow path. In an aspect, the two nonparallel surfaces converge to form the sharp edge. In an aspect, the sharp edge has an angle of 90 degrees or less. In an aspect, the driving device is configured to vibrate the flow generator at the resonance frequency of the flow generator. In an aspect, the driving device is one of piezoelectric stack and a coil. In an aspect, the flow passage comprises a flow restrictor. In an aspect, the flow restrictor is disposed directly proximate the sharp edge of the flow generator. In an aspect, the flow restrictor is a nozzle. In an aspect, the flow restrictor is a one-way valve. In an aspect, the one-way valve is a reed valve. In an aspect, the flow passage comprises a manifold portion dividing the flow portion into a plurality of paths connected in parallel, the flow generator being a first flow generator disposed along a first path of the plurality of paths connected in parallel, the system comprising a second flow generator disposed along a second path of the plurality of paths connected in parallel. In an aspect, the flow generator is a first flow generator disposed along the fluid path, the system comprising a second flow generator disposed along the fluid path, the first and second flow generators being arranged to cooperate to increase the fluid pressure or to increase the flow velocity of fluid in the flow path.

In another exemplary aspect, the present disclosure is directed to a microfluidics acoustic pump system that includes a flow passage configured to carry a fluid from one location to another, a first flow generator disposed within the flow passage and comprising a sharp edge, a second flow generator disposed within the flow passage and comprising a sharp edge, and a driving device configured to vibrate one of a) the first and second flow generators and b) the flow passage to create a streaming fluid flow in a direction away from the sharp edges of the first and second flow generators through the fluid passage.

In an aspect, the first and second flow generators are arranged in parallel. In an aspect, the first and second flow generators are arranged in series. In an aspect, further comprises a flow restrictor in the flow passage. In an aspect, the flow restrictor comprises one of a reed valve and a nozzle.

In another exemplary aspect, the present disclosure is directed to a method comprising providing a flow generator in a flow passage filled with fluid, the flow generator having a sharp edge defined by two nonparallel surfaces forming an angle, the nonparallel surfaces being symmetrically disposed about an axis aligned with an axis of the flow path. The method also comprises vibrating the flow generator with a driving device to vibrate the sharp edge of the flow generator to create fluid flow through the flow passage.

In an aspect, vibrating the flow generator with a driving device comprises vibrating the flow generator with a piezoelectric stack. In an aspect, the method further comprises inhibiting fluid backflow with a flow restrictor in the fluid passage.

In an exemplary aspect, the present disclosure is directed to a microfluidics chip having a plurality of flow passages configured to carry a fluid from one location to another and having a plurality of selectively vibrating flow generators having a sharp edge. At least one of the plurality of selectively vibrating flow generators may be disposed in each of the plurality of flow passages, and the plurality of selectively vibrating flow generators may have different resonance frequencies. A single driving device selectively induces vibrations at the different resonance frequencies of the plurality of flow generators in a manner that permits selective activation of each of the plurality of flow generators by controlling resonant alternating current to the driving device.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

The accompanying drawings illustrate embodiments of the devices and methods disclosed herein and together with the description, serve to explain the principles of the present disclosure.

DETAILED DESCRIPTION OF THE PREFERRED EMBODIMENTS

Figure 1:
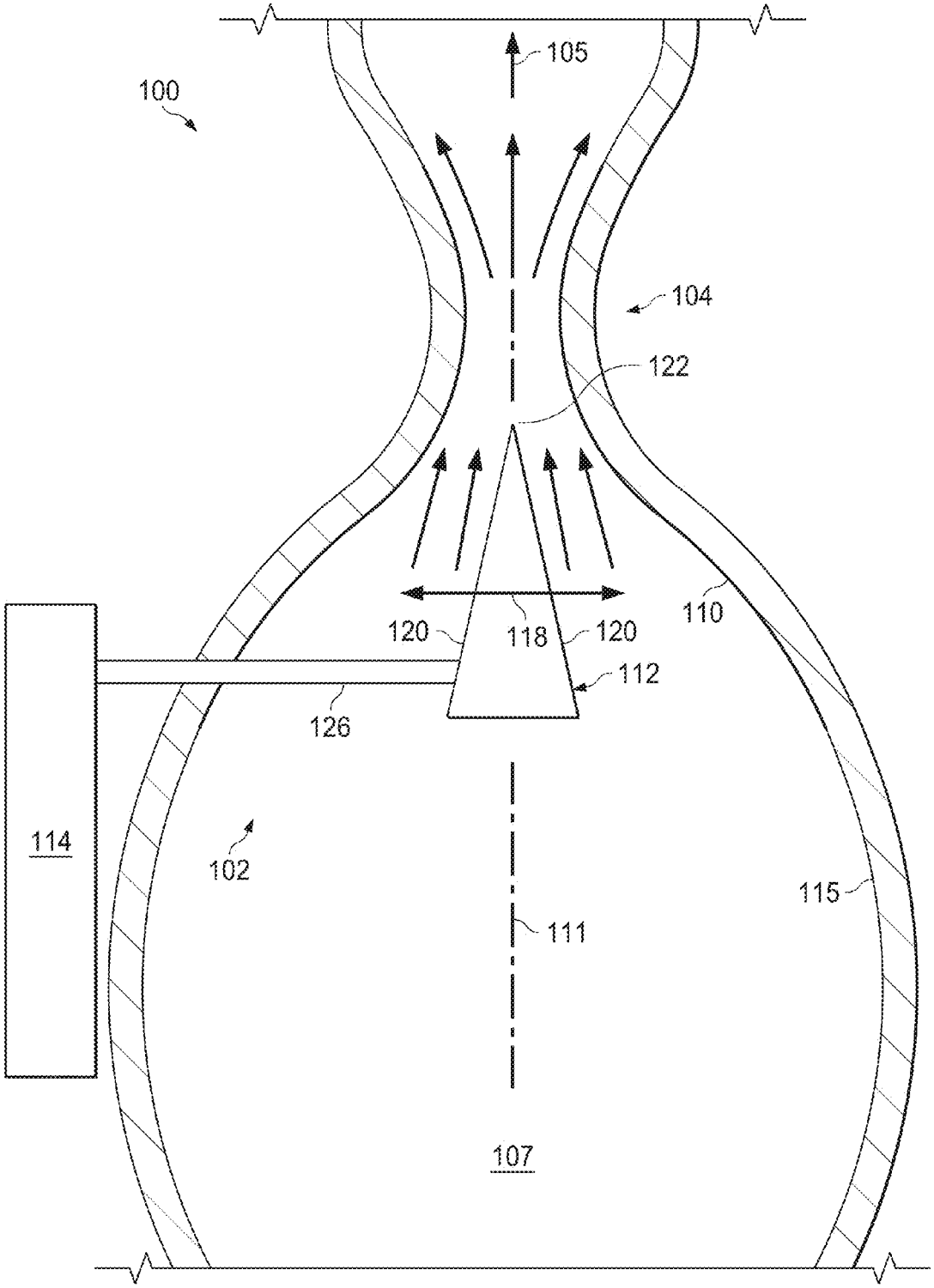
FIG. 1 is an illustration of an exemplary active acoustic fluid pump according to one aspect of the present disclosure implementing the teachings and principles described herein.

For the purposes of promoting an understanding of the principles of the present disclosure, reference will now be made to the exemplary embodiments illustrated in the drawings, and specific language will be used to describe the same. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately. For simplicity, in some instances the same reference numbers are used throughout the drawings to refer to the same or like parts.

The present disclosure relates generally to pumps, pump systems, and methods for acoustic streaming of a fluid. More particularly, the disclosure relates to fluidic micropumps that operate by vibrating a sharp edge to generate anomalous streaming. In general, the pumps and systems have few movable parts making them highly reliable, and they may be easily integrated with other micro-fluidic circuits. In addition, the acoustic pumps and systems may be relatively easy to manufacture as they may be used/built in conjunction with MEMS (micro-electromechanical systems). They also may be customizable as they may be tunable to provide a desired flow rate on-the-fly.

FIG. 1 illustrates an exemplary microfluidic acoustic pump 100. The pump includes an acoustic streaming arrangement 102 and a flow passage 110. The flow passage 110 includes an enlarged portion 107 and a flow restrictor 104. The flow restrictor 104 is a necked-down or narrowed portion of the flow passage 110.

In this embodiment, the acoustic streaming arrangement 102 includes a flow passage 110, a flow generator 112, and a vibration-generating driving device 114. In the illustrated example, the flow restrictor 104 is disposed downstream of the flow generator 112. In other implementations, the flow restrictor 104 may be disposed upstream of the flow generator 112. In still other implementations, the flow generator 112 may be disposed within the portion of the flow passage defining the flow restrictor 104.

The flow passage 110 in this embodiment has a profile shown in FIG. 1. Although shown with an hourglass shape, the flow passage 110 may have other shapes. For example, the flow passage 110 may have any shape that enables passage of fluid from one location to another. In one embodiment, the 3-dimensional shape of the flow passage 110 may be obtained by extruding the profile perpendicular to the plane of the paper. Accordingly, in such an embodiment, the flow restrictor 104 is a slot-like narrowing of the flow passage 110. For reference, a central plane 111 is shown in the flow passage 110. The central plane 111 is shown in FIG. 1 as a line and is intended to represent a plane extending in a direction perpendicular to the plane of the cross-section in FIG. 1. In this example, the central plane is disposed at a location central in the flow passage 110.

The flow generator 112 is configured and arranged to physically displace the fluid in the flow passage 110 in the direction of arrow 105 along the plane 111. Here, the flow generator 112 is disposed directly in the fluid flow. In some instances, the flow generator 112 may be laterally centered within the flow passage 110. Accordingly, the flow generator 112 may be surrounded by fluid in the flow passage 110. In the example illustrated in FIG. 1, the flow generator 112 is a wedge-shaped microscopic blade and is arranged to vibrate at a particular frequency back and forth in a translational manner as indicated by the arrow 118 in FIG. 1. Accordingly, the flow generator 112 may vibrate in a direction perpendicular to the direction of the plane 111. In other embodiments however, the flow generator 112 may pivot about a pivot point in a side-to-side vibratory manner.

Figure 2:
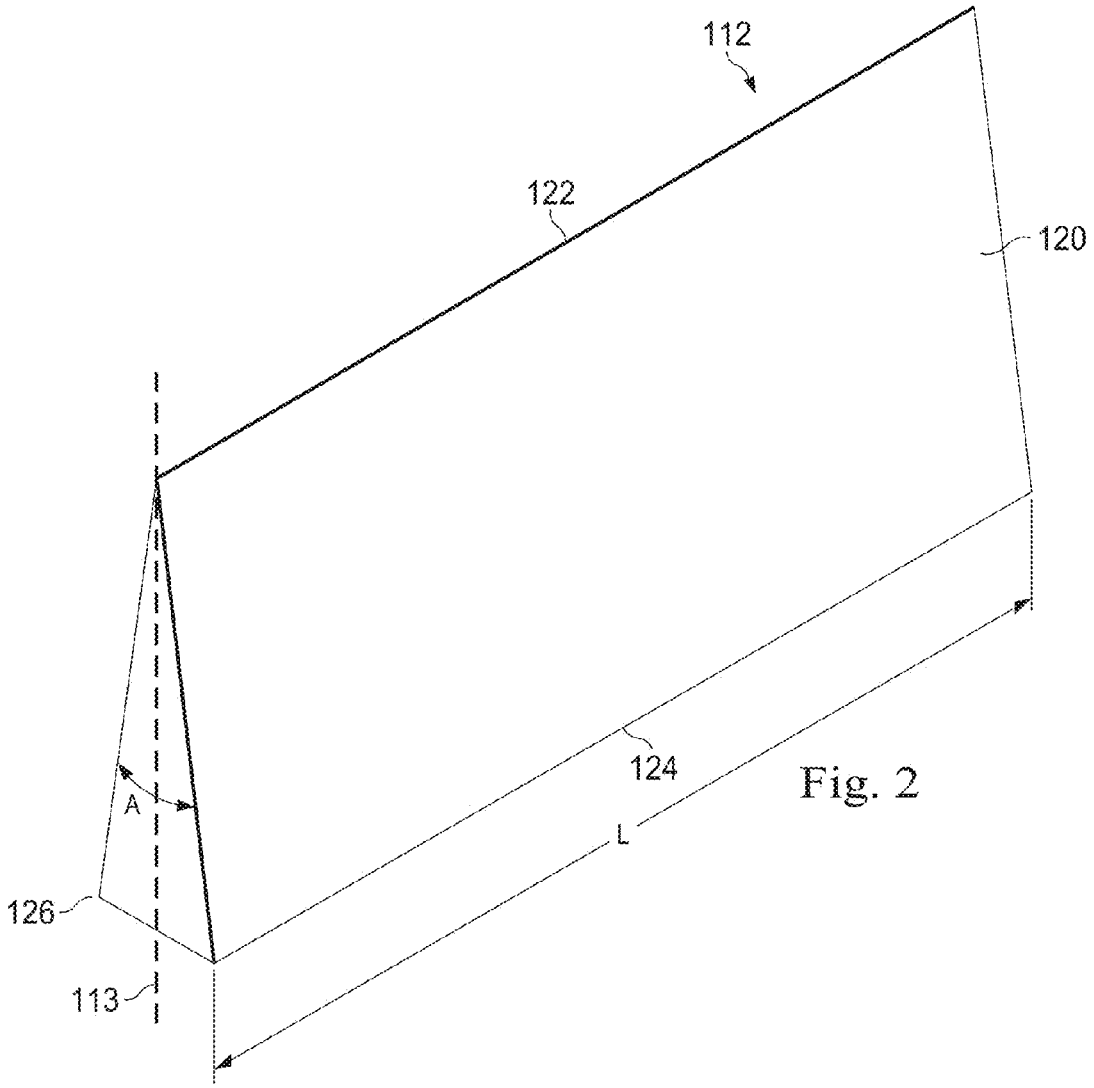
FIG. 2 is an illustration of an exemplary fluid flow generator of the acoustic fluid pump of FIG. 1.

The flow generator 112 is shown in greater detail in FIG. 2. With reference to both FIGS. 1 and 2, the flow generator 112 includes angled, non-parallel sides 120 converging at a sharp edge 122. In this embodiment, the sharp edge 122 has a lateral length L, as can be seen in FIG. 2. In the embodiment shown, the two non-parallel sides 120 form an angle A at the sharp edge 122 of about 20 degrees. However, other angles are contemplated. For example, in some embodiments, the angle A forming the sharp edge 122 is formed at an angle between 10 and 90 degrees. In some embodiments, the angle A is formed at an angle between 10 and 60 degrees, and in some embodiments, angle A is formed at an angle between 15 and 30 degrees. In some embodiments, the angle A is about 30 degrees. Other ranges are also contemplated. In general, the sharper the angle A, the higher the streaming velocities that may be achieved by the acoustic pump 100. Here the sides 120 are symmetrically formed about an axis 113. In the example shown in FIG. 1, the axis 113 aligns with the plane 111 and extends in the direction of the arrow 105. In other embodiments, edges 124, 126 of the flow generator 112 may be rounded or smoothed to reduce or prevent unnecessary streaming or turbulence.

Depending on the embodiment and the amount of fluid to be driven by the pump, the flow generator 112 may have a lateral length L in the range of about 50 microns to 5 cm. In other embodiments, the lateral length L is in the range of about 100 microns to 2 cm. While the flow generator 112 may be formed of any material, in some embodiments, the flow generator 112 may be formed of a steel blade with a 20° sharp edge. In some exemplary embodiments, the flow generator 112 includes rounded edges 124, 126 so that only the edge 122 is sharp. In one example, the flow generator 112 may form a tear-drop shape in cross-section.

Returning to FIG. 1, the vibration-generating driving device 114 is disposed outside the flow passage 110 and is configured to provide an activating force to the flow generator 112 in the flow passage 110. In one exemplary embodiment, the driving device 114 is one or more piezoelectric crystals that may form a piezoelectric crystal stack. When alternating current of a particular frequency is passed through the piezoelectric crystal stack, the stack vibrates at this frequency that may be used to mechanically drive the flow generator 112. In other embodiments, the driving device 114 is an inductive device configured to generate a magnetic field that may drive the flow generator 112. Accordingly, in such embodiments, the flow generator 112 is formed of a magnetic material. The driving device 114 may be or may form a part of other driving systems. Depending on the driving device 114, the principle of vibration generation can be, for example, piezoelectric or inductive. Other principles of vibration generation are also contemplated.

In the exemplary pump 100 shown in FIG. 1, the driving device 114 is mechanically connected to the flow generator 112 by an extending shaft 126. The extending shaft 126 is a rigid shaft capable of translating the vibrations from the driving device 114 to the flow generator 112. Embodiments using inductive magnetic fields to impart vibration to the driving device may perform without a mechanical connection. Other embodiments vibrate the flow passage 110 without vibrating the flow generator 112.

In other embodiments, the flow generator 112 is attached directly to walls 115 defining the flow passage 110. The driving device 114 may be configured to vibrate the flow passage 110 at the resonance frequency of the flow generator 112. This may induce significant vibrations on the flow generator 112 while inducing only minimal vibration on the flow passage 110.

Figure 3:
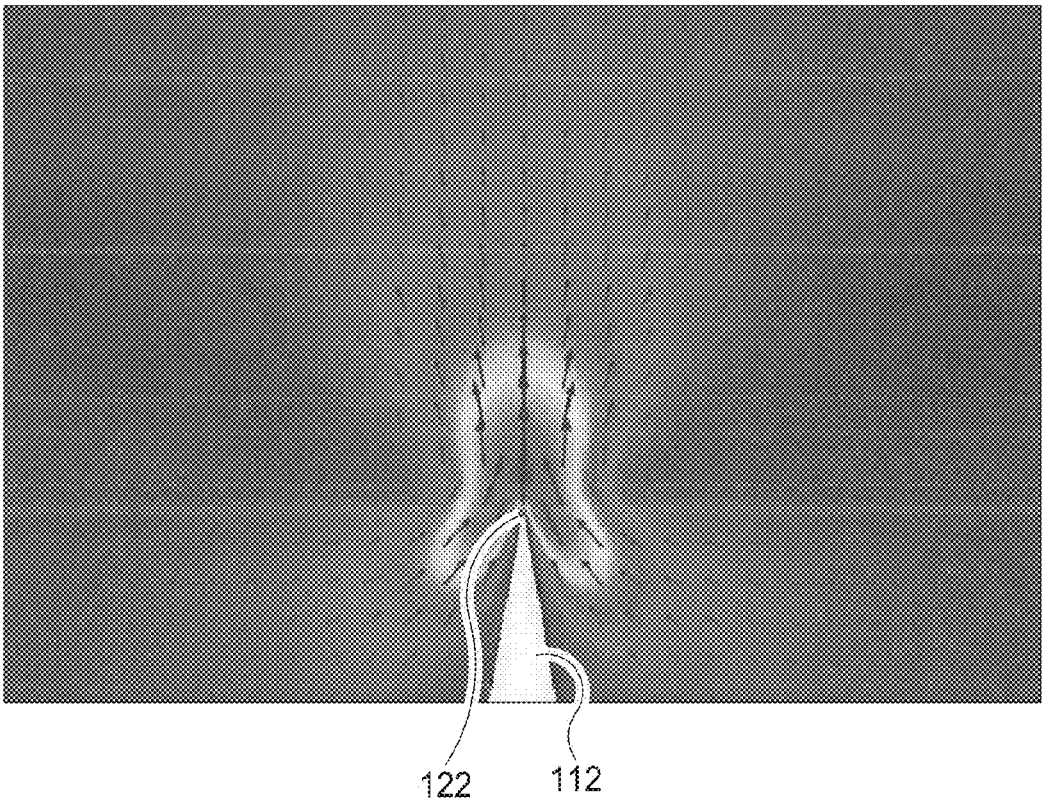
FIG. 3 is an illustration showing the principles of acoustic streaming jet flow obtained using the principles of the present disclosure.

FIG. 1 shows the flow generator 112 in an active condition or an acoustic streaming condition, as indicated by the vector arrows representing flow in the flow passage. Acoustic streaming is a steady streaming flow that is generated due to oscillatory motion of a sharp-edged body in a fluid. The steady streaming flow is represented in the drawing of FIG. 3. Anomalous jets of fluid are generated by and originate from the vibrating sharp edge 122 of the microscopic flow generator 112. In FIG. 3, the vectors represent the fluid velocity of the jets, and as can be seen, the velocity is much greater at the sharp edge 122. The velocities of the jets can be as high as 2 m/s and are significantly higher than can be predicted by smooth edges vibrating laterally. As shown in FIG. 3, the jets of fluid extend substantially perpendicular to the direction in which the flow generator 112 is vibrated and parallel to the axis 113 in FIG. 2.

The anomalous streaming occurs at the sharp edge 122 of the wedge-shaped flow generator 112. The flow generator 112 vibrates in a direction indicated by arrow 118 (shown in FIG. 1), which may be considered perpendicular to its sharp edge 122, and generates a strong microscopic current having a flow profile indicated by the arrows illustrated in FIG. 3. Particularly, the flow generator 112 produces a flow in the direction indicated by the arrow 105 shown in the FIG. 1. The flow generator 112 may be translated in its entirety in the direction of arrow 7 to produce the fluid flow. In other implementations, an end of the flow generator opposite the sharp edge 122 may be pivotably attached to permit the sharp edge 122 to rapidly oscillate, thereby generating the fluid flow.

The spatial extent of this current depends on at least two factors, including the frequency of flow generator vibrations and viscosity of a fluid. For ultrasonic frequencies in water, the current around the flow generator 112 is localized to an area of several microns. The forces that produce such currents are very strong and can easily overcome the surface tension of water and other fluids, which allows the use of this phenomenon to pump fluids like water. Thus, the acoustic streaming from the sharp edge 122 is typically highly localized at the sharp edge 122 with the dimensions that are much smaller than the acoustic wavelength. Because of the sharp edge 122 and the tapering sides 120 of the flow generator 112, the streaming is well localized at the sharp edge 122 and thus does not depend on the overall geometry of the body of the flow generator 112 or the fluid around the body of the flow generator 112.

FIG. 3 also shows the vector field of the frequency dependent fluid velocity. In some examples, the fluid velocity is observed to be the highest just above the sharp edge 122. The flow pattern consists of the stream directed vertically away from the sharp edge 122 which is fed by the streams coming from the sides 120. This pattern has proven to be universal for all angles of the sharp edge 122, fluid viscosities and frequencies of vibration. As indicated above, it should be recognized, however, that as the angle A (shown in FIG. 2) decreases, the velocity of the resulting stream tends to increase.

To induce the streaming, the flow generator 112 may be vibrated at its resonance frequency. In some embodiments, the flow generator 112 may be vibrated at its resonance frequency within a range of about 100 Hz to 10 MHz, for example. In one example, the flow generator 112 is a steel blade, with its sharp edge 122 formed at a 20° angle. In that example, the vibration-generating driving device 114 is operable to vibrate the flow generator 112 at its resonance frequency, which happened to be 461 Hz in water. For explanatory purposes, the acoustic motion introduces a boundary layer along the walls 120 of the flow generator 112. The boundary layer is a low pressure acoustic force area, and it creates a path for fluid to enter. The fluid enters the acoustic force area along the sides 120 of the flow generator 112 and is ejected at the sharp edge 122 driven by the centrifugal force. This results in the streaming pattern from the sharp edge 122.

In some embodiments, the flow rates may be tunable on the fly by modifying the power levels at the driving device 114. For example, increasing or decreasing the power may result in increased or decreased vibrational rate of the flow generator 112, thereby increasing or decreasing the resulting streaming fluid flow. As such, the flow rate and the pressure level may be controlled to desired levels. By tuning the flow to particular levels, the system may have utility in purging operations in small biological volumes.

Returning to FIG. 1, in some implementations, the flow restrictor 104 may be located downstream of the sharp edge 122 of the flow generator 112. Also, in some implementations, the microscopic flow generator 112 may be positioned within the enlarged portion 107 of the flow passage 110. Further, in some embodiments, the flow generator 112 may be coupled to the walls 115. For example, the flow generator 112 may be coupled to the walls 115 forming the enlarged portion 107 of the flow passage 110. The flow restrictor 104 may be instrumental in reducing or preventing backflow when the acoustic streaming arrangement 102 is operating. The flow restrictor 104 here is formed as a slot-shaped nozzle in the flow passage 110. However, other flow restrictors are contemplated, including for example, one-way check valves, reed valves, ball valves, diaphragm check valves, and other types of valves.

Figure 4:
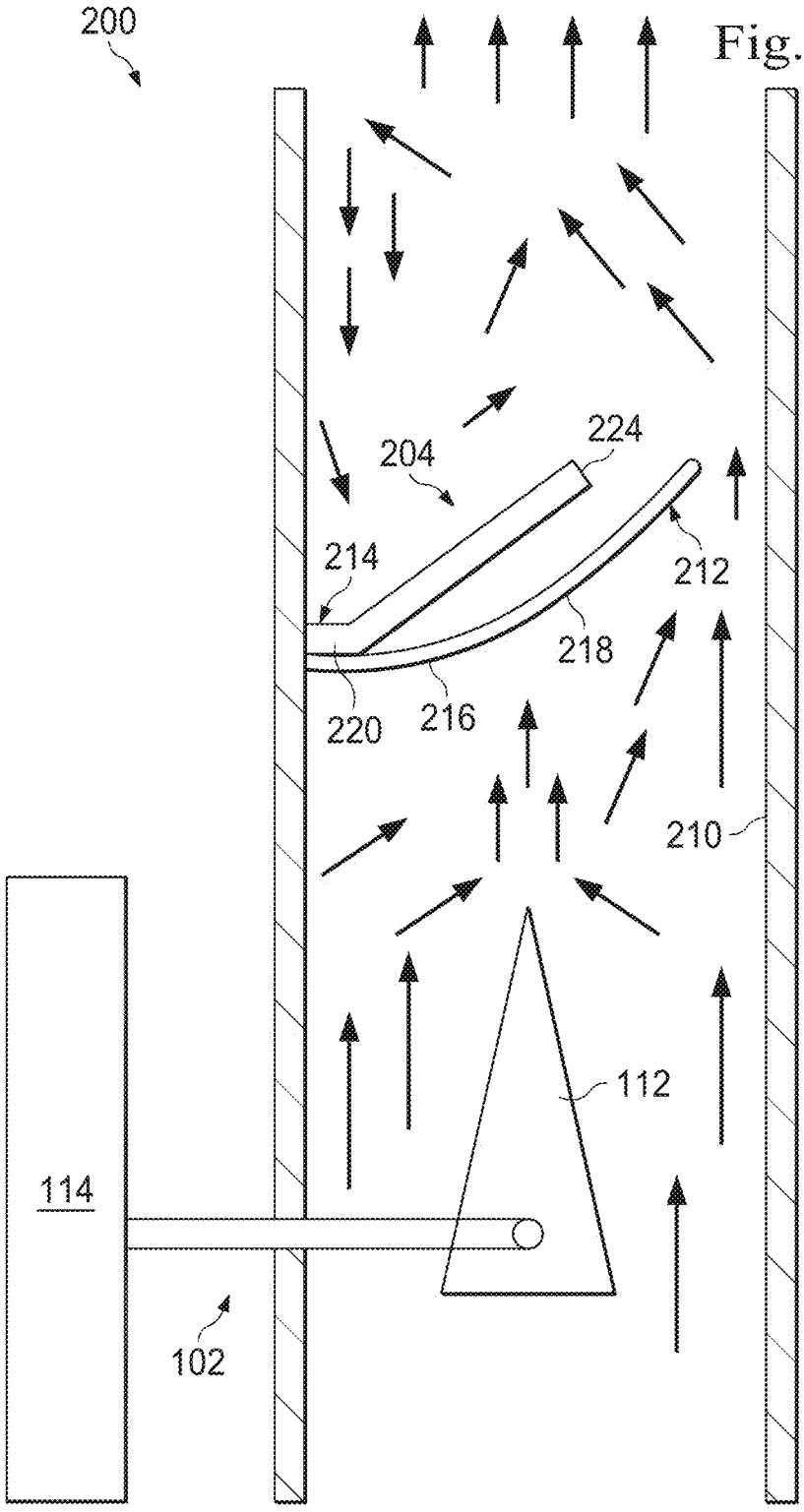
FIG. 4 is an illustration of an exemplary active acoustic fluid pump according to one aspect of the present disclosure implementing the teachings and principles described herein.

FIG. 4 shows another embodiment of an acoustic pump, referenced herein by the numeral 200. This embodiment, similar to those described above, includes the acoustic streaming arrangement 102 and a flow restrictor as a reed valve referenced herein by the numeral 204. In this embodiment, the reed valve flow restrictor 204 is formed within a flow passage 210.

The reed valve flow restrictor 204 includes a reed 212 and a hard stop 214. The reed valve flow restrictor 204 may be used in the pump 200 to permit fluid flow to be delivered at a rated pressure. That is, the cracking pressure and the rate of opening are defined by the stress-strain curve of the material of the reed 212, along with the net pressure difference across the reed 212. Here, the natural frequency of the reed 212 is much lower than the frequency of vibration and hence should not have any resonance problems. An advantage of this embodiment is that an applied pulse of the ultrasound may be tuned to pump the fluid from sharp edge 122 and to crack open the reed valve flow restrictor 204. The geometry of this device including the reed valve flow restrictor 204 and frequency of the flow generator 112 can be optimized for a desired pumping rate and pressure.

In one aspect, the reed valve may serve two functions. First, it operates as a check valve to prevent backward flow. Second, unlike conventional check valves such as a ball valve, the reed valve may be designed to provide stabilizing flow control even during high pressure drop conditions. This is different than conventional spring and ball check valves which have an open condition during higher pressures that permits flow and a closed position at lower pressures that restricts flow. In contrast, the reed valves disclosed herein may stabilize flow by maintaining flow at a satisfactory rate while still permitting a desired fluid flow at low pressure conditions.

In the embodiment shown, the reed valve flow restrictor 204 opens and closes due to the changing pressure across the surface of the reed 212. The hard stop 214 controls the maximum flow through the pump 200. Sophisticated reeds can be created for different gains at different open positions so as to avoid resonance problems. The range of cracking pressure of the reed valve can be anywhere between 3 mmHg to 100 mmHg, for example, although other cracking pressures are contemplated.

In FIG. 4, the reed valve flow restrictor 204 is disposed in the flow passage 210. The reed 212 includes an attachment end 216 and a cantilevered end 218. The attachment end 216 is fixed in place in the flow passage 210, and the cantilevered end 218 is free to move away from the wall of the flow passage 210 to allow fluid to pass, and arranged to engage the wall of the flow passage 210 to prevent backflow.

The reed 212 may be formed of a flexible material and is configured to deflect, where the amount of deflection is dependent on the pressure of the fluid. The reed 212 deflects based on differentials between upstream pressure and downstream pressure behind the reed valve. Based on the stiffness, material, and dimensions of the reed 212, the reed valve flow restrictor 204 may have a cracking pressure set at a desired pressure, such as about 3 mmHg. Therefore, when the upstream pressure is greater than the downstream by more than the cracking pressure, the reed valve flow restrictor 204 will begin to open to relieve pressure. In one example, the reed valve is configured and disposed to have a cracking pressure between about 0.25 mmHg and 8 mmHg.

In one example, the reed 212 is formed of a flexible polymer material. It may be formed of any suitable material, including, for example without limitation, materials such as a silicone, silicon nitride, silicone elastomeric, polyimide, parylene, and others. In addition, the stiffness, material, and dimensions of the reed 212 can be selected to provide a desired gain in response to pressure. Accordingly, the reed 212 may be selected or designed to deflect a particular amount to permit a particular fluid flow based on the pressure amounts.

The hard stop 214 is disposed downstream of the reed 212 and like the reed, extends from one side of the flow passage 210. The hard stop 214 in this example is a rigid element disposed to limit the range of deflection of the reed 212. In this example it includes a transverse segment 220 extending from a wall of the flow passage 210 and includes an angled segment 224 extending from a distal end of the transverse segment 220. In this embodiment, the transverse segment 220 extends in a direction substantially perpendicular from the wall of the flow passage 210. The transverse segment 220 includes a transverse segment length and the angled segment 224 includes an angled segment length. The respective lengths of these segments are selected to provide a desired rigidity and a balanced stability during flow conditions. The hard stop 214 is disposed adjacent the reed 212 and is configured to mechanically interfere with the reed deflection to limit the total gain or size of the flow passageway through the reed valve flow restrictor 204. In this example, the hard stop 214 extends more than half the distance across the flow passage 210.

In one example, the hard stop 214 is disposed to limit the reed deflection to an amount that will limit the flow rate through the valve to prevent overly fast pressure drops in high pressure scenarios. For example, the reed valve flow restrictor 204 may be configured with a deflection resistance that is more controllable than a conventional check valve to prevent excessive gain and thereby stabilize flow during high and low pressure differentials. In one embodiment, the hard stop 214 is located in a manner to affect or limit the deflection of the reed to a particular pressure in the range of 8 mmHg to 15 mmHg. In another embodiment, the hard stop 214 is located in a manner to affect or limit the deflection of the reed when pressures exceed 8 mmHg, 10 mmHg, 12 mmHg, 14 mmHg, or 15 mmHg. FIG. 4 also shows the fluid flow pattern as a result of the reed valve flow restrictor 204.

The acoustic pump 200 with the reed valve flow restrictor 204 may provide stabilizing back pressure that reduces excessive pressure drops while still performing properly during low pressure situations. In one example, the reed valve is configured to provide a back pressure to the acoustic pump that is maintained at a desired level even during pressure variations. This may be designed not only in closed valve situations, such as by the cracking pressure, but also during open conditions, when fluid is flowing.

Figure 5:
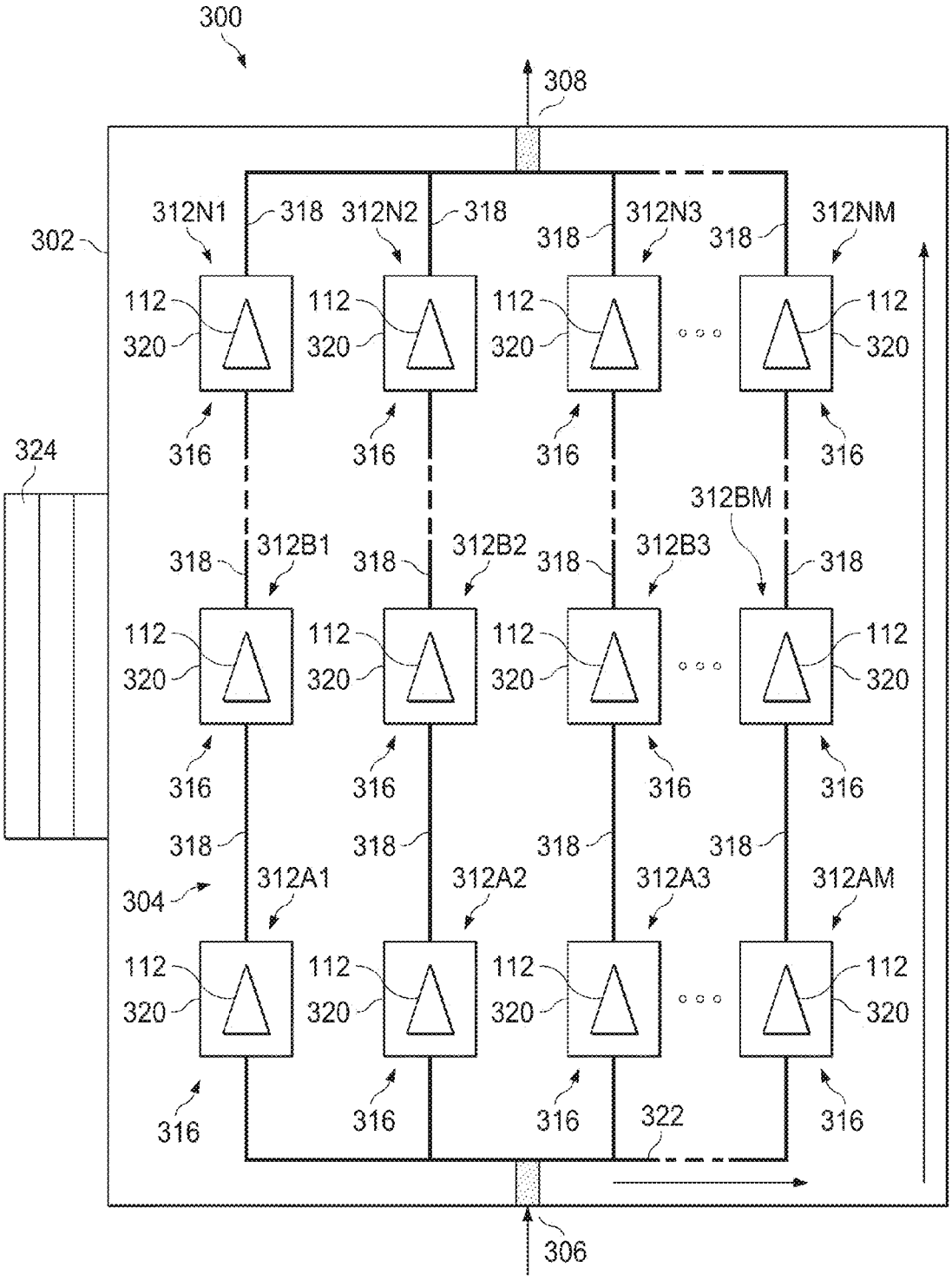
FIG. 5 is an illustration of an exemplary active acoustic fluid pump system according to one aspect of the present disclosure implementing the teachings and principles described herein.

FIG. 5 shows an acoustic pump system 300 using anomalous streaming of fluid by a vibrating sharp edge in microdevices. The pump system 300 may be configured and arranged for microfluid pumping at flow rates and pumping pressures not obtainable by the acoustic pump 100 in FIG. 1. As will become clear from FIG. 5 and the description below, the pump system 300 provides several pumps both in series and in parallel. The pumps in parallel help support higher flow rates and the pumps in series support higher pumping pressure or ejecting fluids at greater velocities for a given flow rate. The system may be modified to include only pumps in parallel or only pumps in series, but the embodiment shown includes pumps in both series and in parallel to increase both the flow rate and the pumping pressure.

In this embodiment, the acoustic pump system 300 is formed of a housing 302 containing a flow passage 304 therethrough. The flow passage 304 includes an inlet 306 to the housing 302 and outlet 308 from the housing 302.

In the embodiment shown, the acoustic pump system 300 includes a plurality of a plurality of smaller acoustic pumps 312. Much of the description of the other acoustic pumps described herein applies to the acoustic pumps 312, and therefore, for the sake of brevity, not every aspect of the acoustic pumps 312 will be repeated. Each pump 312 includes an acoustic streaming arrangement 316 and a flow restrictor 318.

In this embodiment, the flow restrictor 318 is formed as a narrowing exit from an acoustic chamber 320 containing a part of the acoustic streaming arrangement 316. The acoustic chamber 320 of each of the acoustic pumps 312 is an enlarged portion within the flow passage 304. In other embodiments, the flow restrictor 318 is a one-way valve, a reed valve, a nozzle, or other flow restrictor. The acoustic streaming arrangement 316 of each acoustic pump includes a flow generator 112 as described above disposed in each of the acoustic chambers 320 in the flow passage 304. The flow generator 112 may be disposed so that its sharp edge 122 is disposed in close proximity to the flow restrictor 318 so that fluid driven by the edge 122 enters the flow restrictor 318.

As can be seen in FIG. 5, the plurality of acoustic pumps 312 are arranged in rows and columns, and connected in series and in parallel. For example, acoustic pumps 312A1, 312A2, 312A3 . . . 312AM are aligned in parallel. This parallel alignment increases the fluid flow rate through the system by the number of acoustic pumps 312 connected in parallel. To accommodate the in-parallel flow through the pump system 300, the flow passage 304 includes manifold portion 322 dividing the flow passage 304 into a plurality of parallel passages, with the parallel pumps disposed in the parallel passages. It is understood that the pumps and passages aligned in parallel is intended to refer to their relative parallel operation and not necessarily their physical location, although they are shown in FIG. 5 as being in a physical location that is also parallel.

As indicated above, the exemplary pump system 300 also includes pumps aligned in series. In series alignment increases the overall pump pressure of the pump system 300 for a given flow rate. For example, in FIG. 5, acoustic pumps 312A1, 312B1 . . . 312N1 are aligned in series and cooperate to increase the pressure and fluid velocity for a given flow rate. It should be recognized that while the pump system 300 includes acoustic pumps aligned in both parallel and in series, the pumps 312 may be aligned in one independent of the other to increase either the flow rate or the pump pressure as desired.

In this embodiment, the pump system 300 also includes a vibration inducing driving device 324 attached to the housing 302. The driving device 324 is disposed as described above and may be arranged to vibrate more than one flow generator 112. Therefore, it may be mechanically attached to a plurality of flow generators 112 or it may inductively couple or otherwise couple to a plurality of flow generators 112. In some embodiments, the single driving device 324 may simultaneously drive all the flow generators 112. In some embodiments, the vibration-inducing driving device may vibrate the housing 302 instead of vibrating the flow generators 112 in a manner that the relative movement drives fluid through the flow passage 304. In some embodiments the vibration-inducing driving device 324 may vibrate the housing 302 at a driving frequency that is in resonance to vibrations of flow generators 112 relative to the housing 302. Under these conditions, the driving force will result in a weak vibration of the housing 302 and a strong vibration of the flow generators 112. In other implementations, the pump system 300 may include a plurality of driving devices 324.

The acoustic pumps and systems disclosed herein may find particular utility in fluidic micropumps, diagnostics and drug design, purging operations in small biological volumes, implants; medical instruments and tools, drug delivery, ink-jet printing devices, fuel cells, DNA chips, among others. In addition, they may be reliable, easily integrated with other micro-fluidic circuits, and relatively easy to manufacture. They also may be customizable as the micropumps may be tunable to wide range conditions on-the-fly.

In some aspects, a single microfluidic assembly or chip includes multiple acoustic pumps. In some of these embodiments, the multiple pumps may be configured such that the resonant frequency of each flow generator is different. In such embodiments, a single driving device, such as piezoelectric stack, can be used to drive all of the pumps. The frequency of an electrical signal to the driving device will determine the frequency of vibration from the driving device, which in turn determines which of the multiple pumps is activated based on the resonance condition of a particular pump. Accordingly, the driving device provides selective vibration of each flow generator by using resonant alternating current. As a result, the acoustic pumps may be controlled to selectively pump fluid through their respective channel at desired times by controlling the driving device.

Persons of ordinary skill in the art will appreciate that the embodiments encompassed by the present disclosure are not limited to the particular exemplary embodiments described above. In that regard, although illustrative embodiments have been shown and described, a wide range of modification, change, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A microfluidics acoustic pump system, comprising:

a flow passage configured to carry a fluid from one location to another;

a first wedge-shaped flow generator disposed within the flow passage and comprising two planar, nonparallel sides that converge together to form a first sharp edge;

a second wedge-shaped flow generator disposed within the flow passage and comprising two planar, nonparallel sides jointed together at a second sharp edge; and a driving device configured to vibrate the flow passage to create a streaming fluid flow in a direction away from the sharp edges of the first and second flow generators through the flow passage, wherein the driving device is configured to vibrate the first flow generator and the second flow generator at a resonance frequency of the first flow generator and the second flow generator.

2. The microfluidics acoustic pump system of claim 1, wherein the first and second flow generators are arranged in parallel.

3. The microfluidics acoustic pump system of claim 1, wherein the first and second flow generators are arranged in series.

4. The microfluidics acoustic pump system of claim 1, further comprising a flow restrictor in the flow passage.

5. The microfluidics acoustic pump system of claim 4, wherein the flow restrictor comprises one of a reed valve and a nozzle.

6. A microfluidics chip, comprising:

a plurality of flow passages configured to carry a fluid from one location to another;

a plurality of selectively vibrating wedge-shaped flow generators, each of the flow generators comprising two planar, nonparallel sides forming an angle and converging together to form a sharp edge, at least one of the plurality of selectively vibrating flow generators being disposed in each of the plurality of flow passages, the plurality of selectively vibrating flow generators having different resonance frequencies; and a driving device configured to selectively induce vibrations at a first resonance frequency of the different resonance frequencies of the plurality of flow generators in a manner that permits selective activation of a corresponding flow generator of the plurality of selectively vibrating flow generators by controlling a resonant alternating current to the driving device.

7. The microfluidics chip of claim 6, wherein the non-parallel surfaces being symmetrically disposed about an axis aligned with an axis of the flow passage.

* * * * *